US005499727A

United States Patent [19]

Koch

[11] Patent Number: 5,499,727

[45] Date of Patent: Mar. 19, 1996

[54] REEL DISPLAY AND DISPENSING RACK

[75] Inventor: James Koch, 2315 Indian Rd. West, Minnetonka, Minn. 55343

[73] Assignee: James Koch, Minneapolis, Minn.

[21] Appl. No.: 293,176

[22] Filed: Aug. 19, 1994

[51] Int. Cl.[6] ..... A47B 43/00

[52] U.S. Cl. ..... 211/193; 211/94; 211/13; 211/708; 211/103; 242/594.6

[58] Field of Search ..... 211/94, 90, 187, 211/207, 162, 208, 193, 103; 242/594.6, 422.5, 422.4, 422.1, 156.1, 156

[56] References Cited

U.S. PATENT DOCUMENTS 3,152,670 10/1964 Selkress, Jr. ..... 211/187

5,311,729 5/1994 Viaud ..... 242/422.5

*Primary Examiner*—Leslie A. Braun

*Assistant Examiner*—Willie Wendell Berry, Jr.

*Attorney, Agent, or Firm*—J. R. Cwayna

[57] ABSTRACT

A rack system for mounting, displaying and dispensing of spooled cable, wire, chain, rope and the like including a longitudinally extending mounting bar to receive dual reel axle ends for mounting of a reel therebetween or receiving a continuous, multiple or individual axles for mounting a number of reels, at least one spring brake arranged to mount on the mounting bar to work and brake against the spooled material, an adjustable stop bar independently carried to prevent natural spring uncoiling despooling of the material from the reel and a display panel integral with the mounting bar for material identification. The rack provides a unit which allows for ease of individual reel removal, service or replacement; a compact, inherently neat and safe display area and a unit that may be free standing or wall mounted.

18 Claims, 3 Drawing Sheets

REEL DISPLAY AND DISPENSING RACK

RELATED APPLICATIONS

Applicant is not aware of any and has not filed any applications which relate to the invention disclosed herein.

SPONSORSHIP

This invention was not made under any Federally or otherwise sponsored program.

FIELD OF THE INVENTION

This invention relates generally to reel carried material and more specifically to a rack or system for the mounting, display and dispensing of material from spools of the same and more particularly to such a system which incorporates separate or multiple reel mounting, braking of material release and display facilities.

SUMMARY OF THE INVENTION

A wire reel display and dispensing rack adaptable for mounting on a wall or for free base mounting which provides a pair of vertically directed mounting standards having mounting apertures to receive hooks of the attached fixtures.

A first member provides at least a pair of forwardly directed arms received into the standards and providing a first hanger mounting bar extending therebetween and a material description, information indicator receiving plate forwardly of the hanger bar. A second member, which may be integral with the first member provides at least a pair of forwardly directed arms having a material stop bar extending therebetween.

The reel mounting members include hangers of a shape to be carried by the first hanger mounting bar with an upwardly directed, axle receiving slot. These members are provided with parallel sides and thus two upwardly extending slots are provided, such that the ends of a pair of axles may be placed therein.

A braking member includes a first hanger mounting bar engaging end and a braking, spring loaded or biased plate carried by and extending therefrom. The width of such plate is determined to allow it to fit between the flanges of a reel carried between two such reel mounting members. Similarly several braking members may be placed between the flanges of a reel if the reel is particularly wide. The interfit of the braking member to the hanger mounting bar and the material utilized for such braking member provide a continuing braking force against the material on the reel through total removal thereof.

The second member, as a guard, is positionable on the standards in accordance with the size of a reel and will retain any reel material, such as wire, cable or the like to prevent it from extending outwardly from the unit as would be unwound material natural unwinding tendency.

A reel mounting axle is provided with reduced hanger receiving areas on the ends thereof to engage with the sides of the upwardly directed slots. In this manner, a single hanger unit may receive the ends of two such axles.

BACKGROUND AND OBJECTS OF THE INVENTION

In the past, reels have been utilized for the storage, display and dispensing of various materials such as wire, rope, chain and the like. For those that are acquainted with areas of stores wherein such units are maintained, it is often an untidy, disordered and customer dangerous area. Reeled or coiled wire or cable has a natural tendency to uncoil and often these areas will have ends of the wire or cable protruding from the reel to endanger customers. Similarly, chain will often, due to the weight thereof, simply cause the reel to unwind. The same is true with rope.

With applicant's unit a unique reel mounting arrangement is provided which allows for storage, display and dispensing of such materials which prevents uncoiling or the same, provides a product information area, will maintain the material in proper position on the various reels and will further allow ease of access for mounting or changing of a reel or reels.

It is therefore an object of the applicant's invention to provide a reel display and dispensing rack or system which ensures that the material will remain in coiled or spooled condition and will not unwind from the reel by providing a braking device acting on the material.

It is a further object of the applicant's invention to provide a reel display and dispensing rack and system which may be wall mounted or may be provided on a free standing base.

It is a further object of the applicant's invention to provide a reel display and dispensing rack for wire, wire cable, rope, chain and the like which includes a hanger bar with a select plurality of reel hangers, each such hanger designed and constructed to receive an end of two reel axles.

It is still a further object of the applicant's invention to provide a reel display and dispensing rack and system which includes a braking mechanism wherein a braking force is applied directly to the reeled material through the entire removal or dispensing thereof from a full to an empty reel.

These and other objects of the applicant's invention will more fully appear from the accompanying disclosure and drawings.

DESCRIPTION OF A PREFERRED FORM OF THE INVENTION

Figure 1:
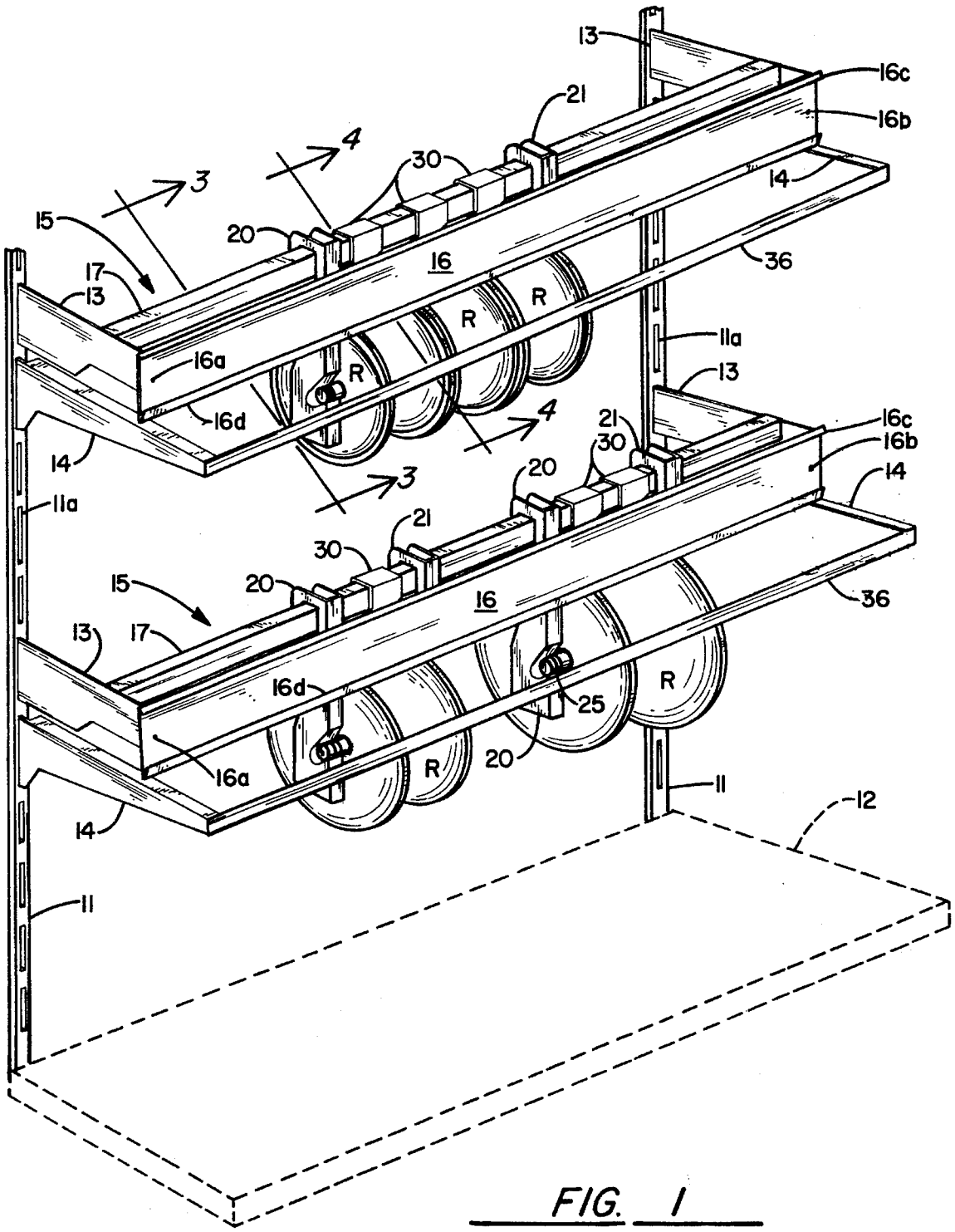
FIG. 1 is a perspective view of applicant's reel display and dispensing rack showing a wall mounting therefore and a free base mounting with the base being illustrated by dotted lines.

In accordance with the accompanying drawings, applicant's wire reel display and dispensing rack is generally designated 10 and is illustrated in FIG. 1 as a wall mounted unit which includes standards 11 arranged for attachment to a wall or other vertical support or as a base provided unit wherein a base 12, shown in dotted lines, is provided and the standards 11 are secured thereto. Such standards 11 are well known in the art and they provide spaced apart vertical apertures to which outstanding supports or to which various hanging units are secured.

As illustrated, the standards 11 are provided with, in the form shown, a plurality of longitudinally arranged slots 11*a* to receive hook elements 13*a*, 14*a* arranged on the rear or attachment ends of mounting arms 13, 14. As illustrated, the mounting arms are of different shapes to accomodate their specific uses. Again, the vertical standards 11, slots 11*a*, arms 13, 14 and hook elements 13*a*, 14*a* are known. The standards may be of various cross sectional forms although a channel or C-shaped cross section obviously allows for hook insertion.

Base 12 is simply, in the form shown, a rectangular member having an upper surface which may be used for additional display such as large reel cages and the standards 11 are rigidly secured thereto to provide a generally vertical support. Similarly, such channels are easily wall mounted.

The first reel mounting section is designated 15 and includes a pair of mirror formed arms 13, each providing hook elements 13*a* on the rear or standard attachment ends thereof and a flat attachment flap 13*b* on the forward end thereof to provide for attachment of display material receiving panel 16 thereagainst through fasteners 16*a*, 16*b*. Display panel 16 may have cupped edges as at 16*c*, 16*d* to receive placards or other article information therein with the same be slidable to affront a particular reel.

Primary mounting bar 17 extends between arms 13—13 and is secured thereto and, as shown, is rectangular in shape.

Figure 2:
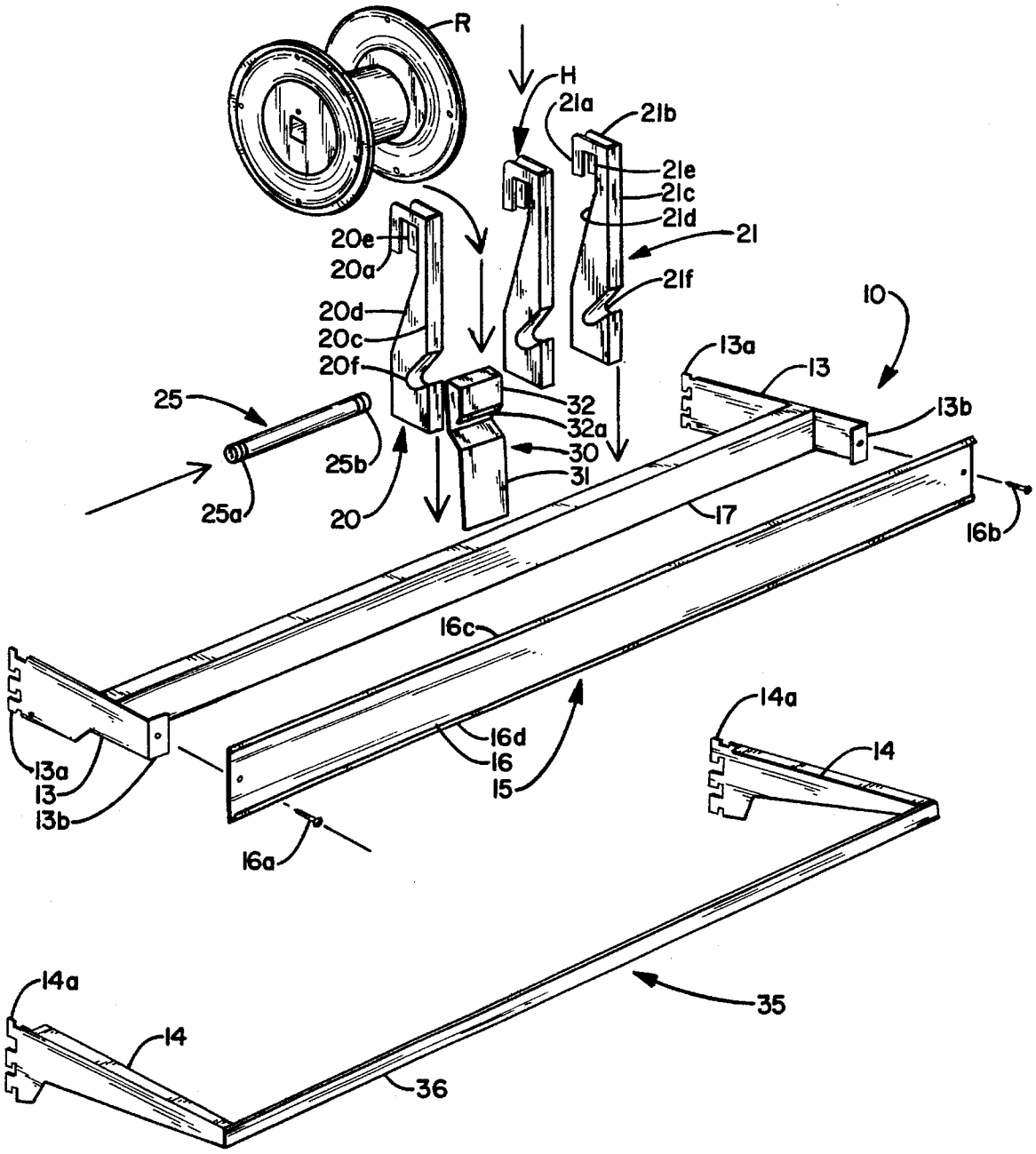
FIG. 2 is an exploded view of the elements of the invention and illustrating one additional hanger element.

FIG. 2 illustrates the various elements of the unit in exploded fashion and is chosen to illustrate the mounting arrangement for a single reel R of material, no material being shown on the reel R.

A pair of reel hangers 20, 21 are illustrated to correspond with a single reel mounting with an additional hanger H being shown simply to show that bar 17 will support a plurality of hangers and thus reels. Each hanger 20, 21 includes a U-shaped member to provide a pair of sides 20*a*, 20*b* and 21*a*, 21*b* respectively, with the connective portion between the sides being designated 20*c*, 21*c*.

As illustrated, a hook arrangement for engagement with bar 17 is provided on each of the sides of the hangers 20, 21 by providing an angled entrance area or side 20*d*, 21*d* to the bar receiving hook area 20*e*, 21*e*. This bar receiving hook area is, as illustrated in FIG. 2 received over bar 17 and the hook area 20*e*, 21*e*, being rectangularly defined will hold such hanger 20, 21 in vertical relation to the bar 17.

A second cut out area is provided through the connective sides 20*c*, 21*c* and into the respective sides 20*a*, 20*b*, 21*a*, 21*b* of hangers 20, 21 to provide a downwardly and inwardly axle receiving portion 20*f*, 21*f* which will, as the units 20, 21 consist of two side plates, provide a pair of axle receiving surfaces.

Axle 25 simply consists of a round, or otherwise formed, longitudinally extending member having reduced areas 25*a*, 25*b* adjacent the ends thereof to fit onto the respective sides 20*a*, 20*b*, 21*a*, 21*b* of the hangers frontal axles receiving areas 20*f*, 21*f* and prevent sideways motion thereof. It should be obvious that each hanger 20, 21 is capable of receiving the ends of two axles 25 or it is possible to use only two such hangers over the length of an entire support bar 17 at the respective ends of a longer than shown axle with midpoint hangers being used.

Such a use would require removal of all reels on a single axle for replacement while the applicant's concept of short axles to correspond to the width of a reel permits ease of access to an individual reel.

A reel material brake member 30 is provided for continuous braking, rotation retarding action to each reel and the material thereon and a number of such brakes 30 may be provided on a single reel if the reel is of sufficient width. The brake 30, besides providing a braking action will also trap and hold the end of the wire that is provided on the reel.

Figure 4:
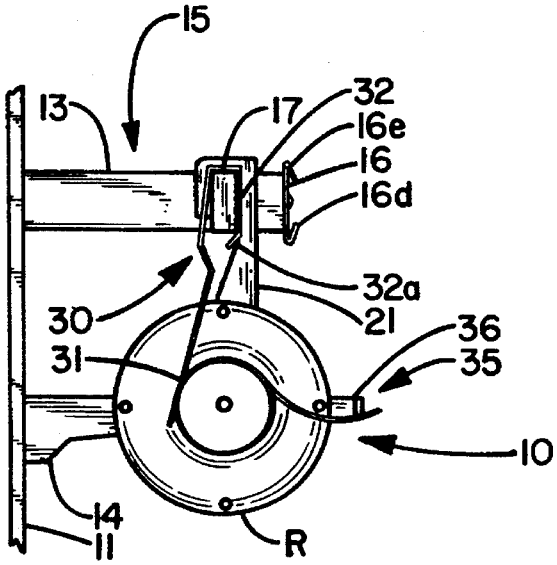

Brake 30 is formed of a spring biased material such as spring steel and includes a downwardly extending leg 31, which extends downwardly from a three sided hook area 32 such that an open, bar receiving area is formed thereby with the frontal area of the third leg being rearwardly formed, as at 32*a*, to ensure that the brake 30 is retained on bar 17. The length of leg 31 is selected, as shown in FIG. 4, sufficiently long to maintain material contact with the reel material during the entire course of removal of the same from the reel. The width of the brake is also determined to allow the leg 31 to pass between the flanges of a reel R to properly provide the braking force against the reel and prevent unwanted or too rapid material removal.

The unit at this point could be considered as being complete but applicant has provided a material end retention device to work in conjunction with the reel mounting and braking unit 15 and this device is designated in its entirety 35. The primary function of this device 35 is to prevent the ends of wire from extending beyond desired parameters, for example into an aisle of a store. Arranged between the forementioned arms 14 is a wire retention and unwinding material stop bar 36 which is mounted with respect to the first or reel mounting unit 15 substantially as shown in FIG. 2 which is in diametric alignment with the reels R. As illustrated in FIG. 2, the ends of the wire will abut with unwinding material stop bar 36 to prevent them from possibly extending outwardly from reel-flange diameter.

As illustrated in FIG. 1, a plurality of reels may be mounted on a single, relatively long, axle with either, only single hangers 20, 21 at its respective ends or with additional mid-point hangers. A plurality of braking members 30 could be provided to act against each single reel. Similarly short axles may be provided along with two hangers per axle for mounting individual reels. Again, similarly each hanger is capable of receiving ends of two axles and therefore, for example, three such hangers could be utilized for two axles and two reels.

Brakes would, of course, be properly provided.

Figure 3:
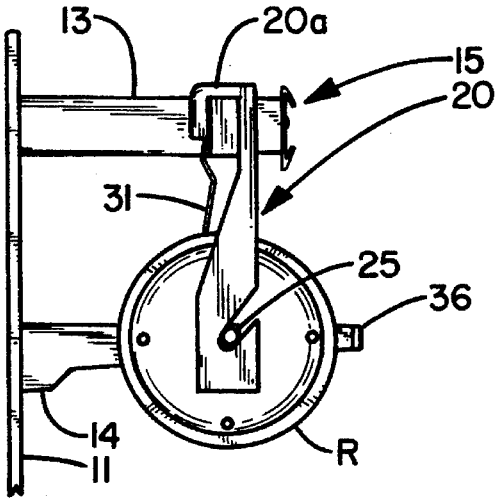
FIG. 3 is vertical section taken substantially along Line 3—3 of FIG. 1; and, FIG. 4 is a vertical section taken substantially along Line 4—4 of FIG. 1.

Although the unit illustrates a downwardly disposed arrangement for hangers, it should be obvious that the hanger bars 17 could be rotated 90° with the associated hangers 20 then being positioned in a horizontal position with the axle receiving slots being upwardly directed. Basically the views of FIGS. 3 and 4 would be rotated 90° counterclockwise. Also maintenance of such hanger rod and hangers could be through a slotted bar and interfitting hanger.

It should be obvious that the applicant has provided a new and unique system for the display of various materials that are normally provided on reels which allows complete access to individual reels, braking for individual reels, material identifying area and material stop members to maintain such display area in a neat, safe condition.

What is claimed is:

1. A reel display and dispensing rack including:

a. vertical support means;

b. a first pair of outstanding support arms having one end thereof arranged for vertically shiftable mounting on said support means;

c. a reel hanging bar secured to said support arms in horizontally spaced relation to said vertical support means;

d. at least a pair of reel support members carried by said reel hanging bar and arranged to extend therefrom;

e. said reel support members including axle receiving hook means on one end thereof; and, f. a reel receiving axle arranged between said reel support members whereby a reel is rotatably mountable on said axle and between said reel support members.

2. The reel display and dispensing rack as set forth in claim 1 and said pair of reel support members extending downwardly from said reel hanging bar.

3. The reel display and dispensing rack as set forth in claim 2 and axle receiving hook means is arranged on the lower end of said reel support members.

4. The reel display and dispensing rack as set forth in claim 3 and said reel support members including a pair of spaced side elements, each of which is provided with a axle receiving hook means whereby a plurality of axles and reels may be maintained on said hanging bar in generally axial alignment.

5. The reel display and dispensing rack as set forth in claim 1 and said axle receiving hook of said reel support members arranged and constructed to receive the ends of two of said axles and maintain the same in axially aligned relation.

6. The reel display and dispensing rack as set forth in claim 4 and;

a. said reel hanging bar being generally rectangular in shape;

b. said reel support members including a generally rectangular hook at the uppermost end thereof receivable about said rectangular hanging bar whereby said reel support member in generally vertical relation.

7. The reel display and dispensing rack as set forth in claim 1 and;

a. reel material brake means arranged and constructed for mounting on said reel hanging bar and extending downwardly therefrom to provide a braking action against the material carried on the reel.

8. The reel display and dispensing rack as set forth in claim 7 and said reel material brake being of a size to fit between the flanges of a reel to engage the material carried thereon.

9. The reel display and dispensing rack as set forth in claim 8 and said reel material brake includes a formed length of material with one end thereof providing a formed hook member whereby the same is positionable about said reel hanging bar.

10. The reel display and dispensing rack as set forth in claim 7 and;

a. said reel hanging bar being of generally rectangular shape and said formed hook member being generally rectangularly formed to engage said hanging bar and be held in generally vertical relation.

11. The reel display and dispensing rack as set forth in claim 10 and said reel material brake being formed of a self biasing material.

12. The reel display and dispensing rack as set forth in claim 7 and a plurality of reel material brake members being provided for each reel of material carried between said hanger members.

13. The reel display and dispensing rack as set forth in claim 1 and a display panel provided on the forward extending ends of said horizontal support arms.

14. The reel display and dispensing rack as set forth in claim 1 and material stop means mounted on said vertical supports and positionable with respect to the reels carried thereon to stop uncoiled material from extending outwardly from said rack.

15. The reel display and dispensing rack as set forth in claim 1 and;

a. a second pair of support arms having one end thereof arranged for vertically shiftable mounting on said support means;

b. a material stop bar arranged between said arms adjacent the outwardly extending end thereof whereby said arms and said material stop bar may be positioned with respect to the reels carried on said hanging bar to prevent material carried by the reels to extend outwardly therefrom.

16. The reel display and dispensing rack as set forth in claim 1 and said vertical support means including a C-shaped channel.

17. The reel display and dispensing rack as set forth in claim 1 and said vertical support being attachable to a wall.

18. The reel display and dispensing rack as set forth in claim 1 and a support base for carrying said vertical support means.

* * * * *